United States Patent [19]

Budzich

[11] 4,362,087

[45] Dec. 7, 1982

[54] FULLY COMPENSATED FLUID CONTROL VALVE

[76] Inventor: Tadeusz Budzich, 80 Murwood Dr., Moreland Hills, Ohio 44022

[21] Appl. No.: 247,887

[22] Filed: Mar. 26, 1981

[51] Int. Cl.[3] ..... F15B 13/08

[52] U.S. Cl. ..... 91/421; 91/446; 137/596.1; 137/596.13

[58] Field of Search ..... 91/421, 446; 137/596.1, 137/596.13

[56] References Cited

U.S. PATENT DOCUMENTS 4,153,075 5/1979 Budzich ..... 137/596.13

4,180,098 12/1979 Budzich ..... 137/596.13

*Primary Examiner*—Gerald A. Michalsky

[57] ABSTRACT

A direction flow control valve for control of positive and negative loads equipped with a positive and negative load compensator controlled by a single pilot valve stage responsive to positive and negative load pressure signals.

30 Claims, 1 Drawing Figure

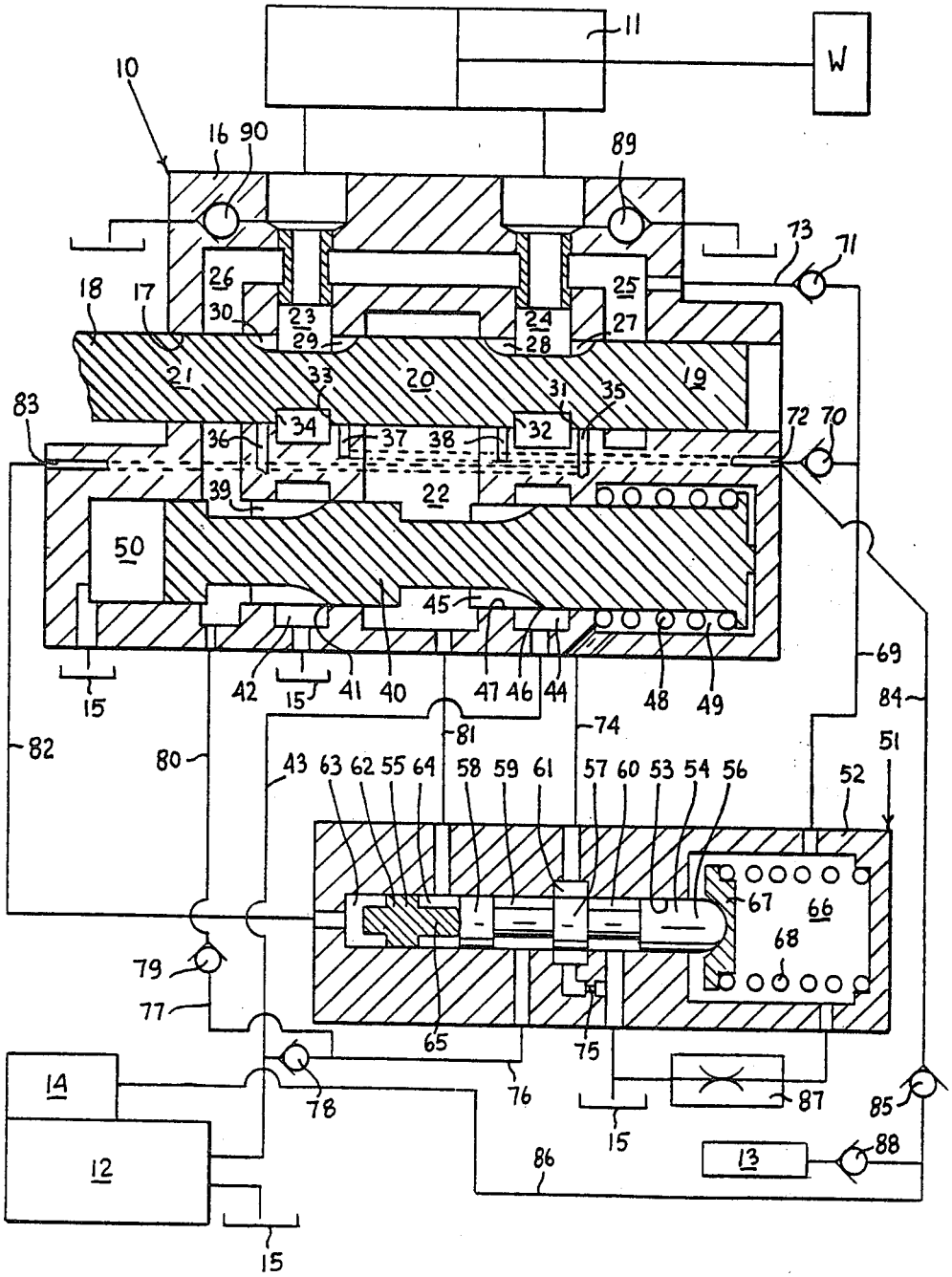
W
10
11
16
90
89
73
71
18
17
26
30
23
29
24
28
25
27
21
33
20
31
35
19
83
34
36
37
38
32
72
70
39
22
50
45
69
42
15
41
40
47
46
44
48
49
84
82
80
81
74
51
43
63
62
55
64
58
59
61
57
60
53
54
56
52
67
66
68
79
77
65
75
14
78
76
87
85
12
86
13
88
15

FULLY COMPENSATED FLUID CONTROL VALVE

BACKGROUND OF THE INVENTION

This invention relates generally to fluid control valves provided with positive and negative load compensation.

In more particular aspects this invention relates to direction and flow control valves capable of proportionally controlling a number of loads under positive and negative load conditions.

In still more particular aspects this invention relates to pressure compensated direction and flow control valves, the positive and negative load compensators of which are controlled by a signal amplifying pilot valve stage.

Closed center fluid control valves, pressure compensated for control of positive and negative loads, are desirable for a number of reasons. They permit load control with reduced power losses and therefore increased system efficiency. They also permit simultaneous proportional control of multiple positive and negative loads. Such fluid control valves are shown in my U.S. Pat. No. 4,180,098, issued Dec. 5, 1979 and also in my U.S. Pat. No. 4,222,409, issued Sept. 16, 1980. However, the valves of those patents, although capable of proportional control of positive and negative loads, use for such control the energy directly transmitted through the load pressure sensing ports, which not only attenuate the control signal, but limit the response of the control.

SUMMARY OF THE INVENTION

It is therefore a principle object of this invention to provide an improved pressure compensated valve, equipped for positive and negative load compensation, in which the positive and negative load compensator is controlled by a single amplifying pilot valve stage.

Another object of this invention is to provide a single signal amplifying pilot valve stage, capable of controlling positive and negative load compensators.

It is a further object of this invention to provide a signal amplifying stage for control of positive and negative load compensators, which uses the energy derived either from the pump or the load for compensator control.

Briefly the foregoing and other additional objects and advantages of this invention are accomplished by providing a novel pressure compensated fluid control system, for use during proportional simultaneous control of multiple positive and negative loads. The pressure compensators of flow control valves of such systems are controlled by a single signal amplifying pilot valve stage, preventing attenuation of the control signals and providing very fast responding proportional flow controls.

Additional objects of this invention will become apparent when referring to the preferred embodiment of the invention as shown in the accompanying drawing and described in the following detailed description.

DESCRIPTION OF THE DRAWING

The drawing is a longitudinal sectional view of an embodiment of a flow control valve provided with a single positive and negative load compensator, also showing a longitudinal sectional view of an embodiment of a pilot valve amplifying stage controlling the compensator with system lines, second flow control valve, system actuator, system pump and system reservoir shown diagrammatically.

DESCRIPTION OF THE PREFERRED EMBODIMENT

Referring now to the drawing, an embodiment of a flow control valve, generally designated as 10, is shown interposed between diagrammatically shown fluid motor 11 driving load W and a pump 12, of a fixed displacement or variable displacement type, driven by a prime mover, not shown. Fluid flow from the pump 12 to flow control valve 10 and a circuit of diagrammatically shown flow control valve 13 is regulated by pump flow control 14. If pump 12 is of a fixed displacement type, pump flow control 14 is a differential pressure relief valve, which, in a well known manner, by bypassing fluid from pump 12 to a reservoir 15, maintains discharge pressure of pump 12 at a level, higher by a constant pressure differential, than load pressure developed in fluid motor 11. If pump 12 is of a variable displacement type, pump flow control 14 is a differential pressure compensator, well known in the art, which by changing displacement of pump 12, maintains discharge pressure of pump 12 at a level, higher by a constant pressure differential, than load pressure developed in fluid motor 11.

The flow control valve 10 is of a fourway type and has a housing 16 provided with a bore 17, axially guiding a valve spool 18. The valve spool 18 is equipped with lands 19, 20 and 21, which in neutral position of the valve spool 18, as shown in the drawing isolate a fluid supply chamber 22, load chambers 23 and 24 and outlet chambers 25 and 26. Lands 19, 20 and 21, of valve spool 18, are provided with metering slots 27, 28, 29 and 30 and control surfaces 31, 32, 33 and 34. Negative load sensing ports 35 and 36 are positioned between load chambers 23 and 24 and outlet chambers 26 and 25. Positive load sensing ports 37 and 38 are located between supply chamber 22 and load chambers 23 and 24. Negative load throttling slots 39, of control spool 40, equipped with throttling edges 41, connect outlet chambers 26 and 25 with an exhaust chamber 42, which in turn is connected to reservoir 15.

The pump 12, through its discharge line 43, is connected to an inlet chamber 44. The inlet chamber 44 is connected through positive load throttling slots 45, on control spool 40, provided with throttling edges 46, with the fluid supply chamber 22. Bore 47 axially guides the control spool 40, which is biased by control spring 48, contained in control space 49, towards position as shown. The control spool 40 at one end projects into control space 49, the other end projecting into chamber 50, connected to the reservoir 15. A pilot valve assembly, generally designated as 51, comprises a housing 52, provided with a bore 53, slidably guiding spool 54 and free floating piston 55. The spool 54 is provided with lands 56, 57 and 58, defining annular spaces 59 and 60. Annular space 61 is provided within the housing 52 and communicates directly with bore 53. The free floating piston 55 is provided with a land 62, which defines annular spaces 63 and 64 and is provided with extension 65, selectively engageable with land 58 of the spool 54. The spool 54 at one end projects into control space 66 and engages, with its land 56 and spring retainer 67, a pilot valve spring 68. Control space 66 communicates through line 69 which check valves 70 and 71. The check valve 70 is connected by passage 72 with positive load sensing ports 37 and 38. The check valve 71 communicates through line 73 with the outlet chamber 25. Annular space 61, of the pilot valve assembly 51, communicates through line 74 with control space 49 and also communicates through leakage orifice 75, with annular space 60, which in turn is connected to reservoir 15. Annular space 59 communicates through lines 76 and 77 with check valves 78 and 79. Check valve 78 is connected to discharge line 43 and check valve 79 is connected, through line 80, with outlet chamber 26. Annular space 64 is connected by line 81 with the supply chamber 22. Annular space 63 is connected by line 82 and passage 83 with negative load sensing ports 36 and 35. Positive load sensing ports 37 and 38 are connected through passage 72, line 84 and a check valve 85 and a signal line 86 with the pump flow control 14. Control space 66 is connected through a leakage device 87 with the reservoir 15. Leakage device 87 may be of a straight leakage orifice type, or may be a flow control device, passing a constant flow from control space 66 to the reservoir 15. The load chambers 23 and 24 are connected, for one way fluid flow, by check valves 89 and 90, to schematically shown system reservoir, which also might be a pressurized exhaust manifold of the entire control system, as shown in the drawing.

The preferable sequenching of lands and slots of valve spool 18 is such, that when displaced in either direction from its neutral position, as shown in the drawing, one of the load chambers 23 or 24 is connected by control surfaces 32 or 33 to the positive load sensing port 37 or 38, while the other load chamber is simultaneously connected by control surface 31 or 34 with negative load sensing port 35 or 36, the load chamber 23 or 24 still being isolated from the supply chamber 22 and outlet chambers 25 and 26. Further displacement of valve spool 18 from its neutral position connects load chamber 23 or 24 through metering slot 28 or 29 with the supply chamber 22, while simultaneously connecting the other load chamber through metering slot 27 or 30 with outlet chamber 25 or 26.

As previously described the pump flow control 14, in a well known manner, will regulate fluid flow, delivered from pump 12, to discharge line 43, to maintain the pressure in discharge line 43 higher, by a constant pressure differential, than the highest load pressure signal transmitted through the check valve system to signal line 86. Therefore, with the valve spool 18, of flow control valve 10, in its neutral position blocking positive load sensing ports 37 and 38, signal pressure input to pump flow control 14 from signal line 86 will be at minimum pressure level, corresponding with the minimum standby pressure of the pump 12.

Assume that the load chamber 23 is subjected to a positive load and that the control pressure differential of the pilot valve assembly 51 is higher than the control pressure differential of the pump flow control 14. The pilot valve assembly 51 is shown on the drawing with the spool 54 in its equilibrium modulating position and with land 57 blocking the annular space 61. With the control system at rest the pilot valve spring 68 will move the spool 54 all the way to the left, connecting annular space 60 with annular space 61 and therefore connecting control space 49 with system reservoir. Under those conditions the control spool 40 will be maintained by the control spring 48 in the position as shown in the drawing. The initial displacement of the valve spool 18 to the right will connect, in a manner as previously described, the load chamber 23, subjected to positive load pressure, with positive load sensing port 37, while also connecting the load chamber 24 with negative load sensing port 35. The positive load pressure signal from positive load sensing port 37 will be transmitted through passage 72, line 84, check valve 85 and signal line 86 to the pump flow control 14 and, in a manner as previously described, will raise the discharge pressure of the pump 12 to a level, higher by a constant pressure differential, than the positive load pressure existing in the load chamber 23.

Further displacement of the valve spool 18 to the right will create a metering orifice through metering slot 29, between the load chamber 23 and the supply chamber 22, while also creating through metering slot 27 a similar metering orifice between the load chamber 24 and the outlet chamber 25. Therefore, fluid flow from the supply chamber 22 to the load chamber 23 will take place at a constant pressure differential, automatically maintained by the pump flow control 18, with the control spool 40 remaining in the position as shown in the drawing and with spool 54 in a positive all the way to the left. Therefore the flow into the load chamber 23 will be porportional to the area of the metering orifice and therefore to the displacement of the valve spool 18 from its neutral position and independent of the magnitude of the load W.

Assume that while controlling positive load W through the flow control valve 10, a higher load pressure signal is transmitted from the schematically shown flow control valve 13 through the check valve 88 and signal line 86 to the pump flow control 14. The discharge pressure of the pump 12 will proportionally increase, increasing the pressure differential between the supply chamber 22 and the load chamber 23. The spool 54, of the pilot valve assembly 51, is subjected to the pressure differential between supply chamber 22 and the load chamber 23, since the annular space 64 is connected by line 81 to the supply chamber 22 and the control space 66 is connected by line 69, the check valve 70, passage 72 and positive load sensing port 37 to the load chamber 23. The increasing pressure differential between the pressure in the supply chamber 22 and the pressure in the load chamber 23 will move the spool 54 from left to right, against the biasing force of the pilot valve spring 68, into a modulating position, as shown in the drawing, increasing pressure in the control space 49, which will move the control spool 40 from right to left, into a position in which it will throttle fluid flow between the inlet chamber 44 and the supply chamber 22. Therefore, the spool 54, in its modulating position, will automatically throttle, by control spool 40, the fluid flow from the inlet chamber 44 to the supply chamber 22 to maintain the pressure differential between the supply chamber 22 and the load chamber 23, at a constant predetermined level, equivalent to preload in the pilot valve spring 68 and lower than the constant pressure differential of the pump flow control 14. Therefore, irrespective of the pump pressure level, the pilot valve assembly 51 will automatically control the throttling action of the control spool 40, to maintain a constant pressure differential between the supply chamber 22 and the load chamber 23, and across the metering orifice, created by displacement of the metering slot 29. During this control action the free floating piston 55 will be subjected to the pressure differential between the supply chamber 22 and the load chamber 24, which is subjected to minimum pressure and therefore it will be maintained in a position all the way to the left, out of contact with the spool 54.

Assume that load chamber 23 is subjected to negative load pressure and that the valve spool 18 was moved to the left, connecting the negative load pressure with the negative load sensing port 36, while also connecting the pressure at minimum level in the load chamber 24 with the positive load sensing port 38. The negative load pressure, from the negative load sensing port 36, will be transmitted through passage 83 and line 82 to annular space 63, where it will react on the cross-sectional area of the free floating piston 55, moving the spool 54 to the right, against the biasing force of the pilot valve spring 68, connecting annular space 59 with annular space 61 and therefore connecting annular space 59 with control space 49. The pump discharge pressure in control space 49 will move the control spool 40 all the way from right to left, isolating with throttling edges 41 the outlet chamber 26 from the exhaust chamber 42.

Further displacement of the valve spool 18 to the left will create a metering flow orifice through metering slot 30, between the load chamber 23 and the outlet chamber 26, while also creating a similar metering orifice, through metering slot 28, between the load chamber 24 and the supply chamber 22, the supply chamber 22 being completely isolated from the inlet chamber 44 by the position of the throttling edges 46. The negative load pressure from the load chamber 23, will be transmitted through created metering orifice to the outlet chamber 26, which is completely isolated from the exhaust chamber 42 by the position of control spool 40. The pressure in the outlet chambers 26 and 25 will rise, will open check valve 17, close check valve 70 and will be transmitted through line 69 to the control space 66, where it will react on the cross-sectional area of spool 54. The rising pressure in control space 66 will move the spool 54 and piston 55 into a modulating position, as shown in the drawing, regulating the pressure in control space 49 and therefore also regulating the position of the control spool 40. The control spool 40 will move from left to right into a throttling position, in which fluid flow from the outlet chamber 26 to the exhaust chamber 42 will be sufficiently throttled, to maintain a constant pressure differential between the load chamber 23 and the outlet chamber 26. The magnitude of this constant pressure differential, the same as that developed when controlling a positive load, is dictated by the preload of the pilot valve spring 68. Therefore the pilot valve assembly 51 will automatically control the throttling action of the control spool 40, to maintain a constant pressure differential between the load chamber 23 and the outlet chamber 26, irrespective of the magnitude of the negative load. Since during control of negative load the supply chamber 22 is completely isolated from the inlet chamber 44, the make-up fluid flow into the load chamber 24 will be supplied, either from the pressurized exhaust manifold or from the system reservoir by the check valve 89. While controlling negative load annular space 59 is connected, through check valve 79, with the outlet chamber 26. If the pump discharge pressure is greater than the negative load pressure in the outlet chamber 26, the check valve 78 will open, the check valve 79 will close and annular space 59 will be subjected to pump pressure, the energy from the pump being utilized to control position of the control spool 40. If the pump is at its standby pressure, which is usually the case when controlling a negative load, the higher negative load pressure will open the check valve 79, close the check valve 78 and be transmitted to annular space 59. Therefore under those conditions the energy to control the position of the control spool 40 will be supplied from the negative load.

The leakage device 87 connects control space 66 with the system reservoir. The leakage device 87 may take the form of a straight orifice, or may take the form of a simple flow control valve, permitting a constant flow, at a very low flow level, from control space 66. Such a leakage flow is necessary to permit the spool 54 to move from left to right. Such a movement will close the check valves 70 and 71, the displaced fluid from control space 66 being passed by the leakage device 87.

The leakage orifice 75 is provided between annular space 61 and system reservoir. Use of such a leakage orifice, well known in the art, increases the stability margin of the pilot valve control.

The pilot valve assembly 51 is phased into the control circuit of the flow control valve 10 in such a way, that it is used to control the throttling action of control spool 40 during control of both positive and negative loads. This arrangement provides not only a less expensive but a more stable control, with identical pressure differential, while controlling positive and negative loads.

The pilot valve assembly 51 utilizes the energy supplied either by the pump or by the negative load in control of control spool 40. This two stage type control uses minimum flows through the load sensing ports and therefore provides a very fast responding control, completely eliminating the influence of the flow forces acting on the control spool 40.

The single stage controls, well known in the art, must control the position of the control spool 40 utilizing the energy transmitted through the load sensing ports. Since the resistance of those load sensing ports to high rates of flow is comparatively large, not only the control pressure signals are severely attenuated, but the response of the control is limited. Also since the throttling spool is directly subjected to the load pressure signals and since the flow forces transmitted to the throttling spool will vary with flow and pressure differential, the control pressure differential of the single stage control will not be constant and will vary with the magnitude of the flow forces. Those above mentioned factors become especially important when using large valves handling large flows. The use of the pilot valve stage eliminates all of those drawbacks and provides a fast responding control, without control signal attenuation and completely independent of the magnitude of the flow forces.

The free floating piston 55 is one of the factors permitting the use of a single pilot valve control in control of both positive and negative loads. During control of positive load the free floating piston 55 is forceably maintained out of contact with the spool 54, by the developed pressure differential. During control of negative load the free floating piston 55 works all the time in contact with the spool 54, the free floating piston 55 and the spool 54 acting as an integral pilot valve spool.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, and fluid exhaust means connected to reservoir means, first valve means for selectively interconnecting said load chambers with said first supply chamber and said fluid exhaust means, first variable metering orifice means responsive to movement of said first valve means and operable to meter fluid flow between said fluid supply chamber and said load chambers, second variable metering orifice means responsive to movement of said first valve means and operable to meter fluid flow between said load chambers and said fluid exhaust means, positive load fluid throttling means between said fluid inlet chamber and said fluid supply chamber, negative load fluid throttling means between said load chambers and said fluid exhaust means, control means of said positive load and said negative load fluid throttling means having pilot amplifying valve means, said pilot amplifying valve means having first control force generating means responsive to pressure differential across said first variable metering orifice means and second control force generating means responsive to pressure differential across said second variable metering orifice means, said pilot amplifying valve means operable through control of said positive load fluid throttling means to maintain a relatively constant pressure differential across said first variable metering orifice means or through control of said negative load fluid throttling means operable to maintain a relatively constant pressure differential across said second variable metering orifice means.

2. A valve assembly as set forth in claim 1 wherein a spring biasing means opposes said first and said second control force generating means.

3. A valve assembly as set forth in claim 1 wherein said valve assembly has positive load pressure sensing means in said housing selectively communicable with said load chambers, by said first valve means.

4. A valve assembly as set forth in claim 3 wherein said positive load pressure sensing means has means communicable with said pilot amplifying valve means and means operable to transmit positive load pressure signal to said pump.

5. A valve assembly as set forth in claim 1 wherein said valve assembly has negative load pressure sensing means in said housing selectively communicable with said load chambers by said first valve means.

6. A valve assembly as set forth in claim 5 wherein said pilot amplifying valve means has free floating piston means responsive to pressure differential between said fluid supply chamber and said negative load pressure sensing means.

7. A valve assembly as set forth in claim 1 wherein sequencing means connects said positive and negative load fluid throttling means.

8. A valve assembly as set forth in claim 1 wherein said positive load fluid throttling means has fluid isolating means between said fluid inlet chamber and said fluid supply chamber operable to isolate said fluid inlet chamber from said fluid supply chamber when said negative load fluid throttling means throttles fluid flow between one of said load chambers and said fluid exhaust means.

9. A valve assembly as set forth in claim 8 wherein said valve assembly has fluid replenishing means operable to supply fluid flow from said fluid exhaust means to one of said load chambers which is not pressurized when said fluid isolating means isolates said fluid supply chamber from said fluid inlet chamber.

10. A valve assembly as set forth in claim 1 wherein said negative load fluid throttling means is positioned down stream of said second variable metering orifice means.

11. A valve assembly supplied with pressure fluid by a pump, said valve assembly comprising a housing having a fluid inlet chamber, a fluid supply chamber, first and second load chambers, a fluid control chamber, and fluid exhaust means connected to reservoir means, first valve means for selectively interconnecting said load chambers with said fluid supply chamber and said fluid exhaust means, first variable metering orifice means responsive to movement of said first valve means and operable to meter fluid flow between said fluid supply chamber and said load chambers, second variable metering orifice means responsive to movement of said first valve means and operable to meter fluid flow between said load chambers and said fluid exhaust means, second valve means having positive load fluid throttling means between said fluid inlet chamber and said fluid supply chamber, negative load fluid throttling means between said load chambers and said fluid exhaust means, and force generating means responsive to pressure in said fluid control chamber, control means having pilot amplifying valve means, said pilot amplifying valve means having first control force generating means responsive to pressure differential across said first variable metering orifice means, second control force generating means responsive to pressure differential across said second variable metering orifice means, and pressure control means for controlling pressure in said fluid control chamber, said pilot amplifying valve means operable through said pressure control means by controlling pressure in said fluid control chamber to throttling fluid flow by said positive load fluid throttling means to maintain a relatively constant pressure differential across said first variable metering orifice means or to throttle fluid flow by said negative load fluid throttling means to maintain a relatively constant pressure differential across said second variable metering orifice means.

12. A valve assembly as set forth in claim 11 wherein spring biasing means opposes force developed by force generating means of said second valve means.

13. A valve assembly as set forth in claim 11 wherein a spring biasing means opposes said first and said second control force generating means.

14. A valve assembly as set forth in claim 11 wherein said valve assembly has positive load pressure sensing means in said housing selectively communicable with said load chambers, by said first valve means.

15. A valve assembly as set forth in claim 14 wherein said positive load pressure sensing means has means communicable with said pilot amplifying valve means and means operable to transmit positive load pressure signal to said pump.

16. A valve assembly as set forth in claim 11 wherein said valve assembly has negative load pressure sensing means in said housing selectively communicable with said load chambers by said first valve means.

17. A valve assembly as set forth in claim 16 wherein said pilot amplifying valve means has free floating piston means responsive to pressure differential between said fluid supply chamber and said negative load pressure sensing means.

18. A valve assembly as set forth in claim 11 wherein said positive and negative load fluid throttling means are positioned on said second valve means.

19. A valve assembly as set forth in claim 11 wherein said positive load fluid throttling means has fluid isolating means between said fluid inlet chamber and said fluid supply chamber operable to isolate said fluid inlet chamber from said fluid supply chamber when said negative load fluid throttling means throttles fluid flow between one of said load chambers and said fluid exhaust means.

20. A valve assembly as set forth in claim 19 wherein said valve assembly has fluid replenishing means operable to supply fluid flow from said fluid exhaust means to one of said load chambers which is not pressurized when said fluid isolating means isolates said fluid supply chamber from said fluid inlet chamber.

21. A valve assembly as set forth in claim 11 wherein said negative load fluid throttling means is positioned down stream of said second variable metering orifice means.

22. A valve assembly comprising a housing having an inlet chamber connected to a pump and an outlet chamber connected to exhaust means, first valve means operable to selectively communicate said inlet and said outlet chambers with a fluid motor, first control orifice means interposed between said inlet chamber and said fluid motor, second control orifice means interposed between said fluid motor and said outlet chamber, second valve means having positive load fluid throttling means between said inlet chamber and said pump and negative load fluid throttling means between said outlet chamber and said exhaust means, said positive and said negative load fluid throttling means controllable by a pilot valve means and operable either to throttling fluid flow by said positive load fluid throttling means to maintain a constant pressure differential across said first control orifice means or to throttle fluid flow by said negative load fluid throttling means to maintain a constant pressure differential across said second control orifice means.

23. A valve assembly comprising a housing having an inlet chamber connected to a pump and an outlet chamber connected to exhaust means, means operable to selectively communicate said inlet and said outlet chambers with a fluid motor, first control orifice means interposed between said inlet chamber and said fluid motor, second control orifice means interposed between said fluid motor and said exhaust means, positive load fluid throttling means between said inlet chamber and said pump, and negative load fluid throttling means between said outlet chamber and said exhaust means, said positive and said negative load fluid throttling means controllable by a fluid power amplifying and control means and operable either to throttle fluid flow by said positive load fluid throttling means to maintain a relatively constant pressure differential across said first control orifice means or to throttle fluid flow by said negative load fluid throttling means to maintain a relatively constant pressure differential across said second control orifice means.

24. A valve assembly as set forth in claim 23 wherein said fluid power amplifying and control means include pilot amplifying valve means.

25. A valve assembly as set forth in claim 23 wherein said positive load fluid throttling means includes isolating means operable to isolate said pump from said motor when said motor is interconnected with said exhaust means through said negative load fluid throttling means.

26. A valve assembly as set forth in claim 25 wherein fluid replenishing means interconnects for one way fluid flow said fluid motor with said exhaust means when said isolating means isolates said pump from said fluid motor.

27. A valve assembly as set forth in claim 24 wherein said positive load and said negative load fluid throttling means are located on throttling controller means.

28. A valve assembly as set forth in claim 27 wherein said throttling controller means has means responsive to said fluid power amplifying and control means.

29. A valve assembly as set forth in claim 23 wherein fluid power directing means supplies energy to said fluid power amplifying and control means either from said pump or from a negative load supported by said fluid motor.

30. A valve assembly as set forth in claim 29 wherein said fluid power directing means includes check valve logic means.

* * * * *